US007278692B2

(12) United States Patent
Sollami

(10) Patent No.: US 7,278,692 B2
(45) Date of Patent: Oct. 9, 2007

(54) BIT BLOCK WITH SHROUD PROTECTOR

(76) Inventor: Jimmie L. Sollami, 1017 Weaver Rd., Herrin, IL (US) 62948

( * ) Notice: Subject to any disclaimer, the term of this patent is extended or adjusted under 35 U.S.C. 154(b) by 0 days.

(21) Appl. No.: 11/248,371

(22) Filed: Oct. 12, 2005

(65) Prior Publication Data

US 2007/0080575 A1 Apr. 12, 2007

(51) Int. Cl.
*E21C 35/18* (2006.01)

(52) U.S. Cl. ..... 299/106

(58) Field of Classification Search ..... 299/106, 299/107, 108

See application file for complete search history.

(56) References Cited

U.S. PATENT DOCUMENTS 3,544,166 A * 12/1970 Proctor ..... 299/103
3,833,264 A * 9/1974 Elders ..... 299/110
4,208,816 A * 6/1980 West ..... 299/113
4,844,550 A * 7/1989 Beebe ..... 299/107
6,712,431 B1 * 3/2004 Bosch et al. ..... 299/104
2002/0074851 A1 * 6/2002 Montgomery, Jr. ..... 299/107
2004/0051369 A1 * 3/2004 Luciano ..... 299/87.1

OTHER PUBLICATIONS

Kennametal, "Chain and Wheel Trenching Tools," Copyright 2001 by Kennametal, Inc,. Latrobe, PA 15650.

* cited by examiner

*Primary Examiner*—John Kreck
(74) *Attorney, Agent, or Firm*—Pitts & Brittian, PC

(57) ABSTRACT

A bit block for use in excavation and mining. The bit block is adapted to receive a bit and to be welded to equipment utilized for boring, drilling, trenching and mining. The bit block is designed to secure and protect the bit while it is penetrating rock and hardened earth material. The bit block defines a shroud adapted to receive and protect the distal end of the bit. The bit block defines an enlarged welding surface to enhance the integrity of the weld. The bit block defines a plow on its leading end to assist in removing excavated material.

22 Claims, 8 Drawing Sheets

BIT BLOCK WITH SHROUD PROTECTOR

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to the field of earth and mining working equipment. More particularly, this invention pertains to an earth and mining bit block which is configured for mounting on earth displacement equipment and to receive a bit for penetrating hardened earth, rock and mining materials.

2. Description of the Related Art

It is well known in the art of earth and mining working equipment that replaceable bits are used for engaging the material to be removed. These bits are typically received within a bit block which is carried by the earth working equipment. Depending upon the particular piece of equipment, the bit blocks may be received on a chain attachment or rotatable drum device utilized for trenching, drilling, boring in rock and mining. A cutting tool or bit is either rotatably received within or welded into the bit block, depending upon the particular application. Typically, it is the practice to rotatably mount the bit in the bit block in order to accomplish a more even wear on the bit and to prolong its useful life. When the bit becomes worn down from excavation and mining, the penetrator is removed from the bit block and replaced.

A conventional bit block 10P, as illustrated in PRIOR ART FIG. 1, is configured for mounting a bit 60. While there are various configurations of a conventional bit block 10P, a conventional bit block includes generally a block adapted to be received on selected earthworking or mining equipment 66, and a receptor formed in the block for receiving the shank 62 of a bit 60. Typically, the receptor 14P is defined by a through opening whereby a portion of the distal end 64 of the shank 62 extends through the bit block 10P in order to receive a retainer clip (not shown) for securing the bit 60 in the bit block 10P. Other conventional bit blocks are described in Kennametal's Catalog "Chain and Wheel Trenching Tools" (Fall 2001).

A conventional bit block 10P defines an engagement surface 38P for engaging the equipment 66 to which it is to be secured. The bit block 10P is typically mounted on the equipment 66 by welding about the perimeter 40P of the engagement surface 38P. Illustrated in FIG. 1, the bit block 10P is welded to a chain 68. While illustrated as being welded to a chain 68, it is well known that inherent problems exist with respect to protecting the distal end 64 of the bit 60 when the bit block 10P is welded to a drum or other conventional apparatus, as well, and specifically related to the build up of excavated material. It is well known in such applications that the top portion of the chain 68 typically has at least a small amount of slack, which allows the chain 68 to sag. As a result, it is a common problem that the bolts 70 used to secure the individual panels into the chain 68, in some situations, creates an undesirable engagement between the distal end 64 of the bit shank 62 and the bolts 70. After repeated incidents of engagement, the distal end 64 of the bit shank 62 becomes deformed, thereby making removal of the bit 60 difficult, if not impossible.

A conventional bit block 10P further defines a leading surface 34P whose furthermost point is coincident with the leading edge of the engagement surface 38P. As illustrated in FIG. 1, the leading surface 34P of the bit block 10P is substantially orthogonal with the engagement surface 38P.

Typically, in order to remove materials excavated by the bit 60, rakes 80 are installed between pairs of horizontally aligned bit blocks 10P. As the chain 68 is driven, the rakes 80 collect materials and move them outside the working area.

BRIEF SUMMARY OF THE INVENTION

A bit block is disclosed for use in excavation and mining. The bit block is adapted to receive a bit and to be welded to a chain excavator, rotatable drum, or the like which is utilized for boring, drilling, trenching and mining. The bit block is designed to secure and protect the bit while it is penetrating rock and hardened earth material. The bit block is configured to protect the distal end of the bit when used in chain excavator applications. The bit block is further configured to provide an enlarged welding surface, whereby the bit block yields reduced tendencies to be inadvertently dislodged from the excavating or mining equipment. The bit block is further configured to assist in removing excavated material during use.

The bit block defines a body including a bit receptor, a trailing edge that is defined on a trailing end, a gusset defining a leading end, and a welding surface defining a welding edge. The bit receptor is defined by a through opening adapted to receive the shank of a bit. The through opening opens on an upper surface and a lower surface of the bit block. The through opening is adapted such that the distal end of the shank extends from the receptor. The distal end of the shank of the bit is adapted to receive a removable locking clip.

A shroud is defined at the trailing end of the bit block. The shroud serves as a protector for the distal end of the shank of the bit. The leading end of the bit block defines a leading edge disposed forward from the welding edge such that a plow is defined by the portion of the leading end below the leading edge and the equipment to which the bit block is attached. The plow is configured to remove excavation material. To this extent, the welding edge of the bit block is welded to a plate which is bolted to the chain excavator or other mining or excavating devices.

The shroud is disposed on the trailing end of the bit block, and is defined by an inner wall and an outer wall. The inner wall at least partially encircles the protruding lower end of the shank of the bit. In the preferred embodiment, the shroud encircles at least a radial arc of greater than 180 degrees. In one embodiment, the inner wall of the shroud completely encircles the protruding lower end of the shank of the bit. The height of the shroud is greater than the length of the protruding distal end of the shank of the bit so that the distal end of the shank of the bit is received within the shroud.

In one embodiment, the leading edge of the present invention extends outward on both sides of the bit receptor so that the leading edge is wider than the bit receptor. The welding edge of the bit block is also wider than the bit receptor and therefore, provides an increased welding surface. The extensions on either side of the bit receptor serve to remove material from the ditch, chain or drum.

In one embodiment of the invention, a replaceable bearing sleeve is disposed within the through opening and is configured to receive the shank of the bit. The bearing sleeve is a hollow cylinder and is defined by an outside surface and an inside surface. The outside surface is adapted to be received in the through opening of the bit receptor of the bit block. The inside surface is adapted to receive at least a portion of the shank of the bit. The bearing sleeve serves to reduce wear on the bit block caused by the movement of the shank of the bit during excavating.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
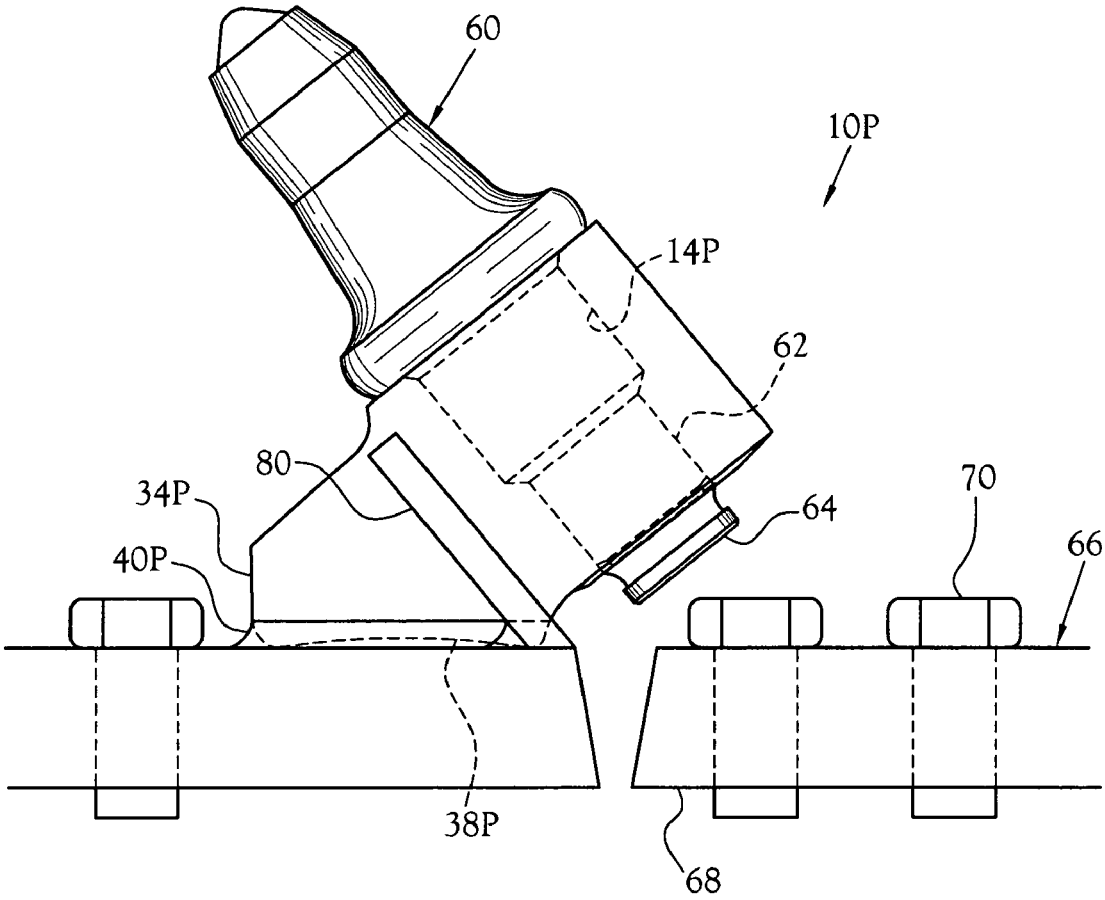
Fig.1 (PRIOR ART)
FIG. 1 is a side elevation view of a prior art bit block mounted on chain excavating equipment with a bit inserted therein.

A bit block is disclosed for use in excavation and mining. The bit block is illustrated generally at 10 in the figures. The bit block 10 is adapted to receive a bit 60 and to be welded to a chain excavator, rotatable drum, or the like which is utilized for boring, drilling, trenching and mining. The bit block 10 is designed to secure and protect the bit 60 while it is penetrating rock and hardened earth material. When a bit 60 becomes worn through use, it is removed from the bit block 10 and replaced. The bit block 10 is configured to protect the distal end 64 of the bit shank 62 when used in chain excavator applications and the like. The bit block 10 is further configured to provide an enlarged welding surface 38, whereby the bit block 10 yields reduced tendencies to be inadvertently dislodged from the excavating or mining equipment. The bit block 10 is further configured to assist in removing excavated material during use.

Figure 2:
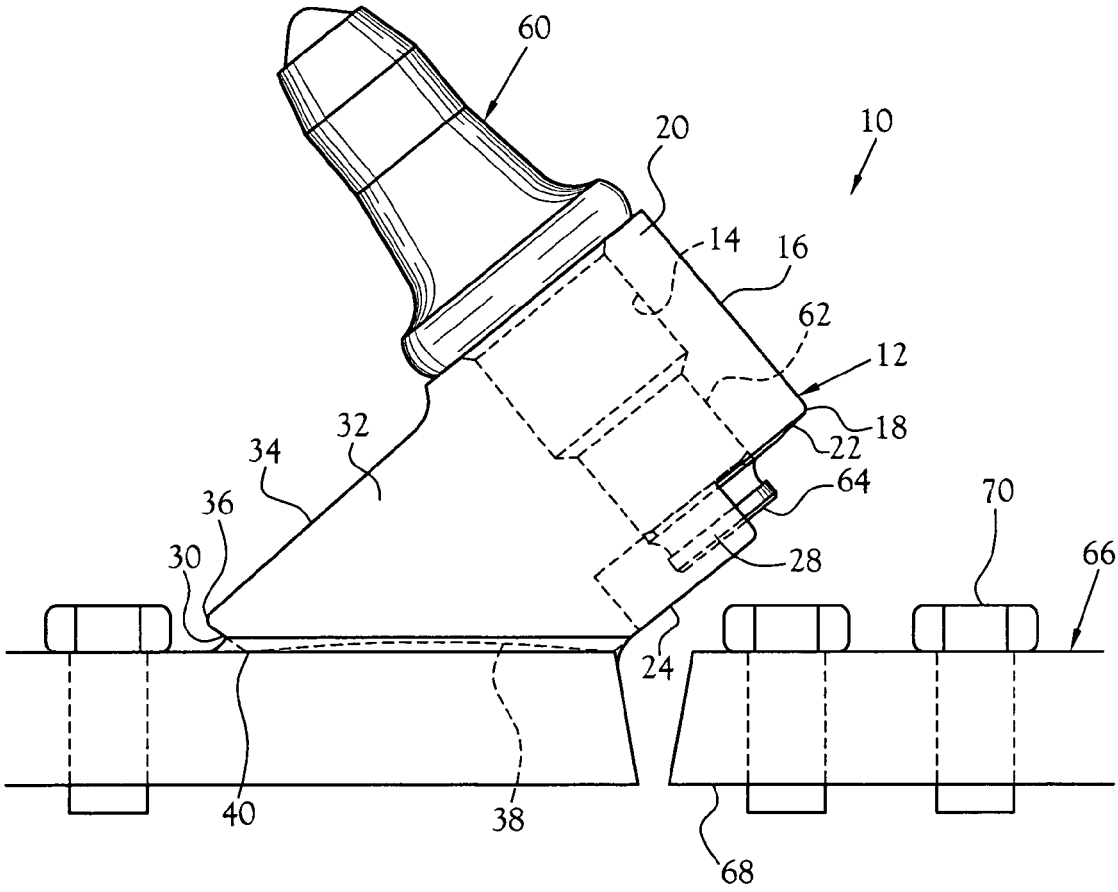
FIG. 2 is a side elevation view of a bit block constructed in accordance with various features of the present invention, the bit block being mounted on a chain excavating equipment with a bit inserted therein.
Figure 3:
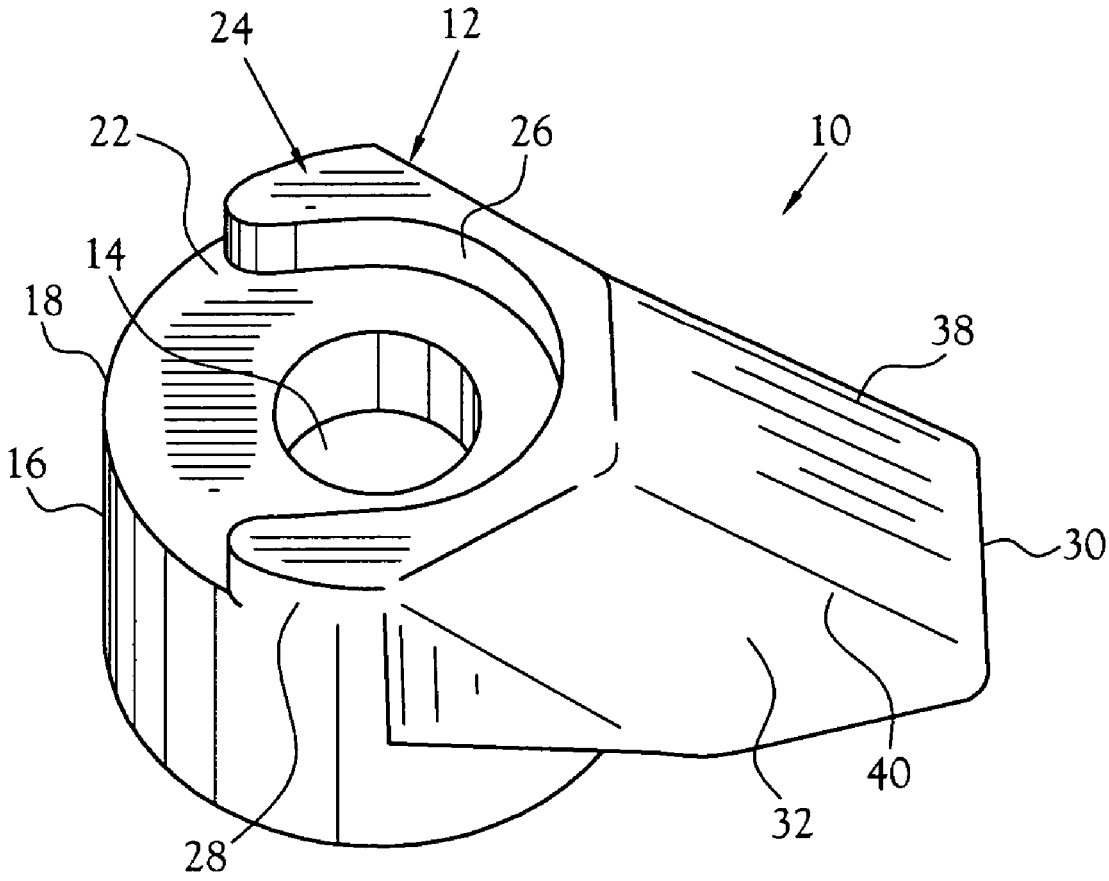
FIG. 3 is a bottom perspective view of the bit block of the present invention illustrated in FIG. 2.

As illustrated in FIG. 2, the bit block 10 defines a body 12 including a bit receptor 14, a trailing edge 18 that is defined on a trailing end 16, a gusset 32 defining a leading end 34, and a welding surface 38 defining a welding edge 40. The bit receptor 14 is defined by a through opening adapted to receive the shank 62 of a bit 60. The through opening 14 opens on an upper surface 20 and a lower surface 22 of the bit block 10. FIG. 3 more clearly illustrates both the welding surface 38 and the lower surface 22 of the bit block 10. The through opening 14 is adapted such that the distal end 64 of the shank 62 extends from the receptor 14. The distal end 64 of the shank 62 of the bit 60 is adapted to receive a removable locking clip (not shown).

In the illustrated embodiment, the gusset 32 is extended forward as compared to conventional bit blocks in order to enlarge both the welding surface 38 and the welding edge 40. The forward extended gusset 32 assists the plow 30 discussed below in moving excavated material to a point away from the bit block 10, and more specifically, to a point away from the distal end 64 of the bit 60. In so doing, material is prevented from collecting under the distal end 64 of the bit 60 and the likelihood of damage is greatly diminished.

A shroud 24 is defined at the trailing end 16 of the bit block 10. The shroud 24 serves as a protector for the distal end 64 of the shank 62 of the bit 60. The leading end 34 of the bit block defines a leading edge 36 disposed forward from the welding edge 40 such that a plow 30 is defined by the portion of the leading end 34 below the leading edge 36 and the equipment 66 to which the bit block 10 is attached. The plow 30 is configured to remove excavated material. To this extent, the welding edge 40 of the bit block 10 is welded to a plate 68 which is bolted to a chain (not illustrated) carried by the chain excavator or other mining or excavating devices 66.

As a result of the shroud 24, the body 12 defines an enlarged diameter and width, as compared to conventional bit blocks. Specifically, the diameter of the body 12 about the bit receptor 14 is enlarged to accommodate the shroud 24. As a result of the increased diameter, the body 12 helps to deflect excavated material from under the distal end 64 of the bit 60, thereby further enhancing the protective performance of the bit block 10.

As discussed above, removal of the bit 60 from a conventional bit block often becomes tedious if not impossible. During excavating, the plates 68 on the excavator equipment 66 slacken causing the bolts on the plates to hit the distal end 64 of the bit shank 62. The shroud 24 is disposed on the trailing end 16 of the bit block 10, and is defined by an inner wall 26 and an outer wall 28. The inner wall 26 at least partially encircles the protruding shank distal end 64. In the embodiments illustrated in FIGS. 2-5, 7 and 8, the inner wall 26 of the shroud 24 at least partially encircles the protruding shank distal end 64. In the preferred embodiment, the shroud 24 encircles at least a radial arc of greater than 180 degrees. In the embodiment of FIG. 6, the inner wall 26A of the shroud 24A completely encircles the protruding shank distal end 64. The height of the shroud 24 is greater than the length of the protruding shank distal end 64 so that the shank distal end 64 is received within the shroud 24. Thus, the shroud 24 serves as a protector for the distal end of the shank distal end 64, as the bolt head 70 engages the shroud 24 rather than the shank distal end 64 when the plates 68 on the chain excavator 66 retains slack. The shroud 24 therefore, minimizes the mushrooming to the shank distal end 64 and allows for easy removal of the bit 60 from the bit block 10. These embodiments provide protection to the shank 62 of the bit 60 while allowing for removal and securement of the removable locking clip.

Figure 4:
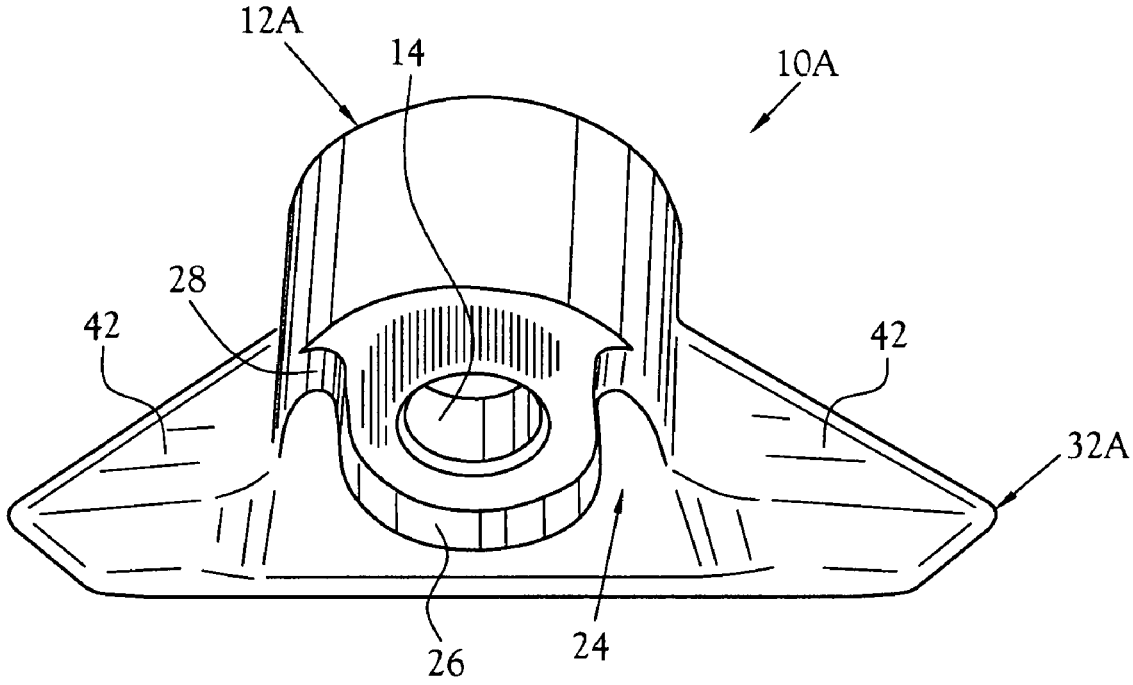
FIG. 4 is a rear elevation view of an alternate embodiment of the bit block of the present invention.
Figure 5:
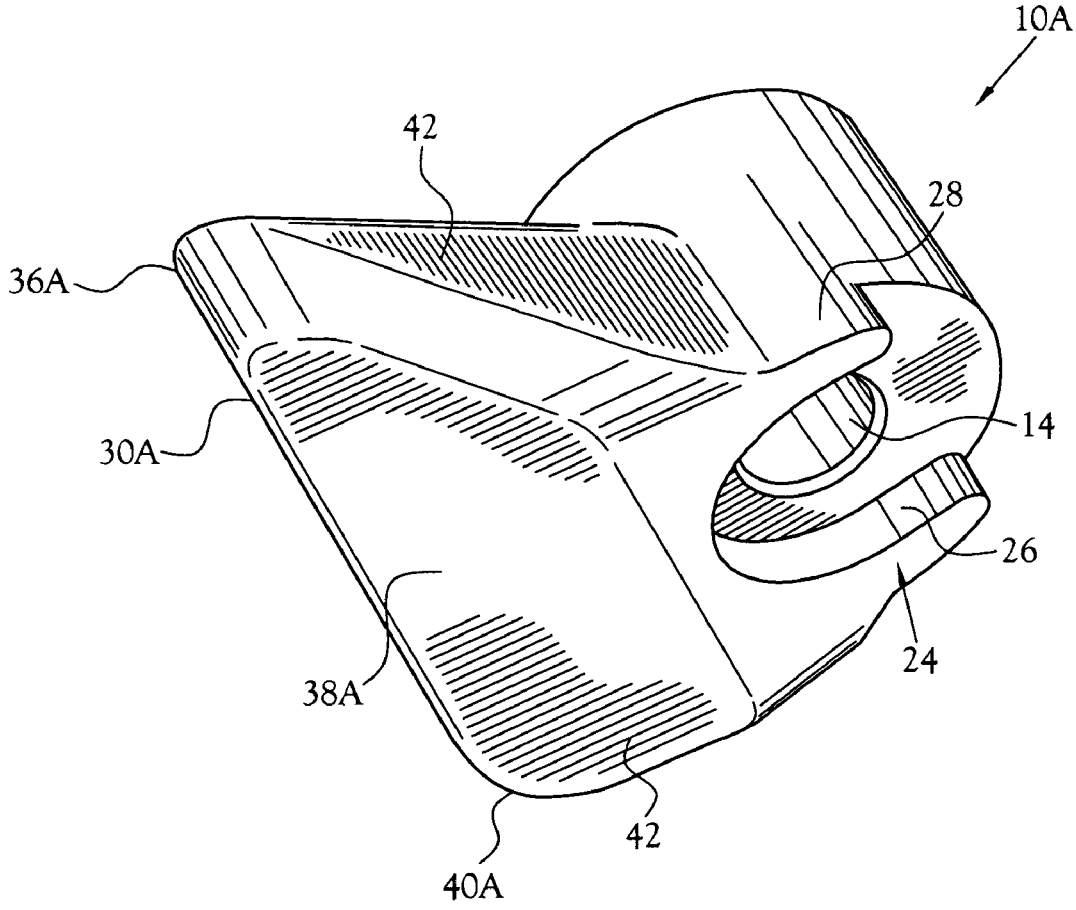
FIG. 5 is a bottom perspective view of the alternate embodiment of the bit block of the present invention illustrated in FIG. 4.
Figure 6:
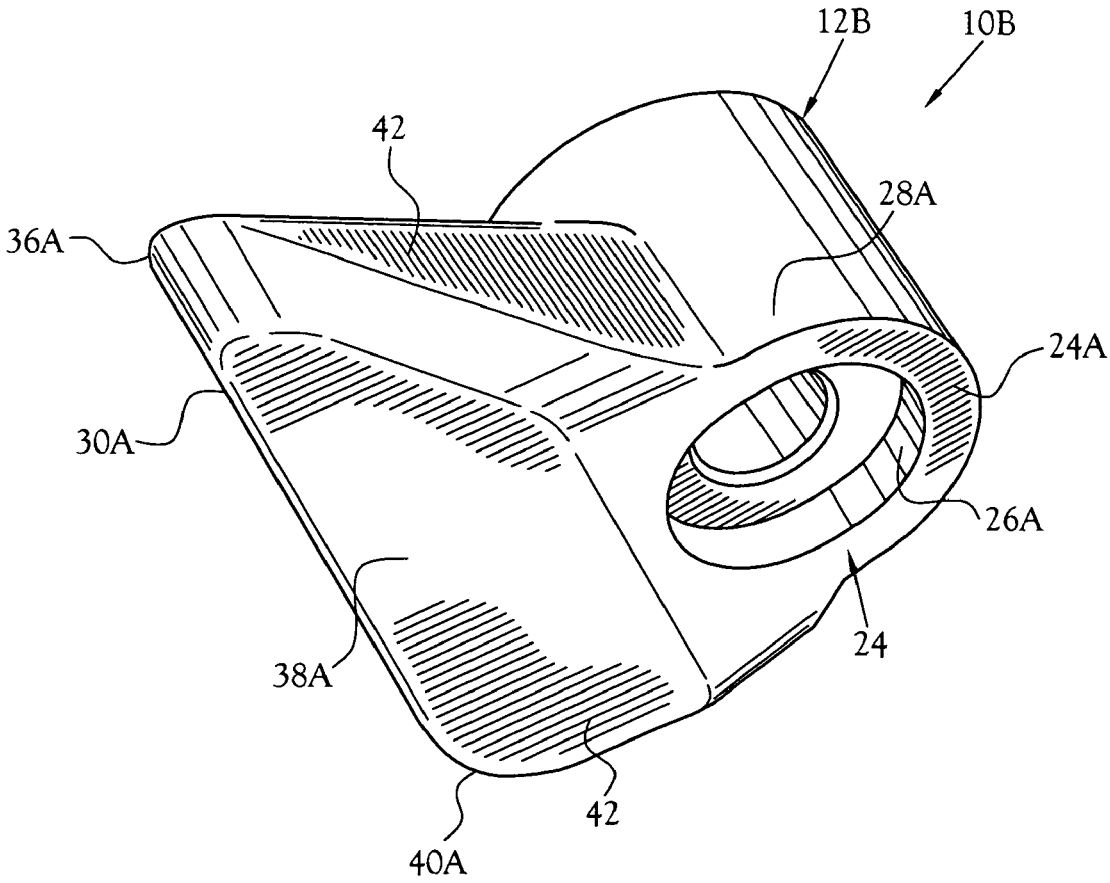
FIG. 6 is a bottom perspective view of a further alternate embodiment of the bit block of the present invention.

In the embodiments illustrated in FIGS. 4-6, the leading edge 36A of a bit block 10A (FIGS. 4 and 5) and a bit block 10B (FIG. 6) of the present invention extends outward on both sides of the gusset 32A to define an extended portion 42. As a result, as illustrated in FIGS. 5 and 6, both the leading edge 36A and trailing edge define a length greater than the width of the body 12A,12B of the bit block 10A,10B. In this embodiment, the leading edge 36A is configured to maximize removal of the excavated material, thereby maximizing the efficiency of the excavation procedure.

Further as a result of the extended portions 42, the welding edge 40A of the bit block 10A,10B is increased. A large welding surface 38A is desired because bit blocks 10 are sometimes inadvertently removed from the plate 68 due to the great pressure on them during excavating. The present invention therefore, provides a stronger bond between the bit block 10A,10B and the plate 68 and is less likely to be removed from the plate 68.

Figure 7:
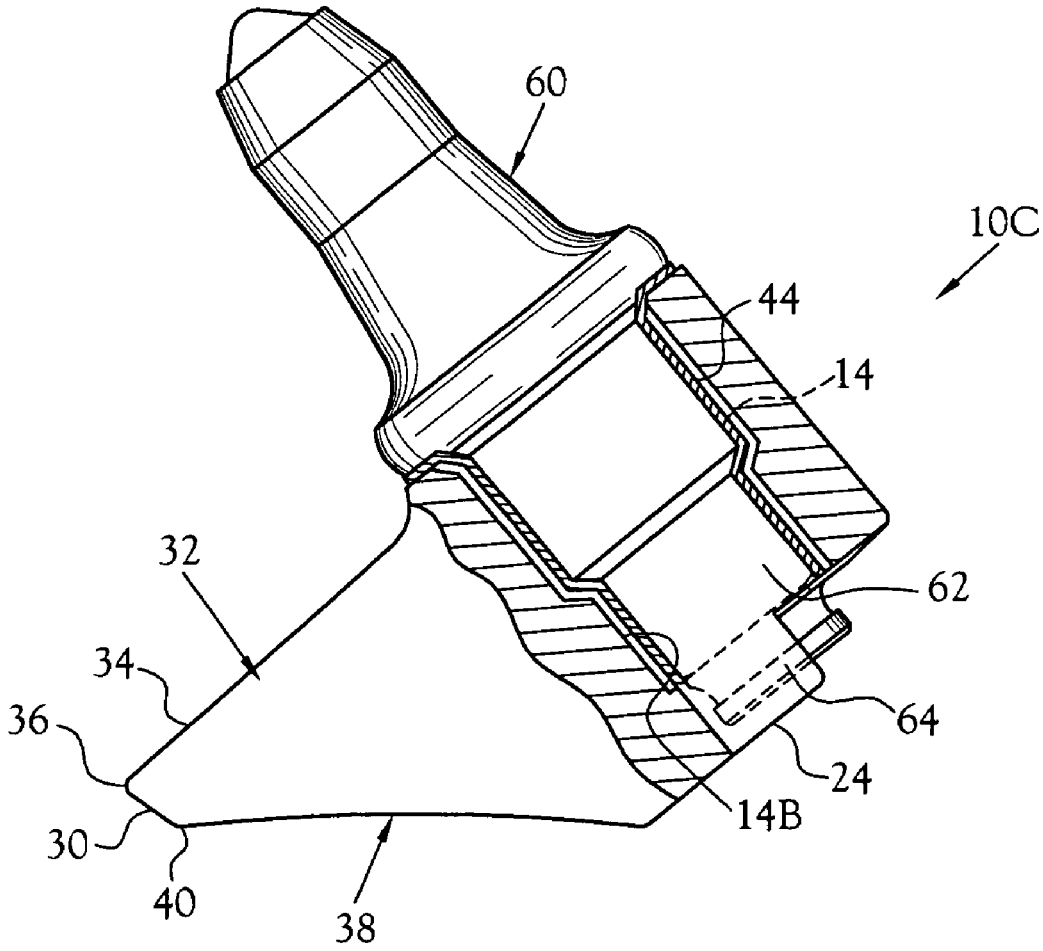
FIG. 7 is a side elevation view of a further alternate embodiment of the bit block of the present invention, the bit block being adapted to receive a bearing sleeve.

Illustrated in FIG. 7 is a bit block 10C of the invention with a replaceable bearing sleeve 44 adapted to be received within the bit receptor 14B, and further configured to receive the shank 62 of the bit 60. The bearing sleeve 44 is a hollow cylinder and is defined by an outside surface 46 and an inside surface 48. The bearing sleeve 44 serves as a bearing surface between the bit 60 and the bit block 10C and reduces the wear on the bit block 10C caused by the movement of the shank 62 of the bit 60 during excavating.

Figure 8:
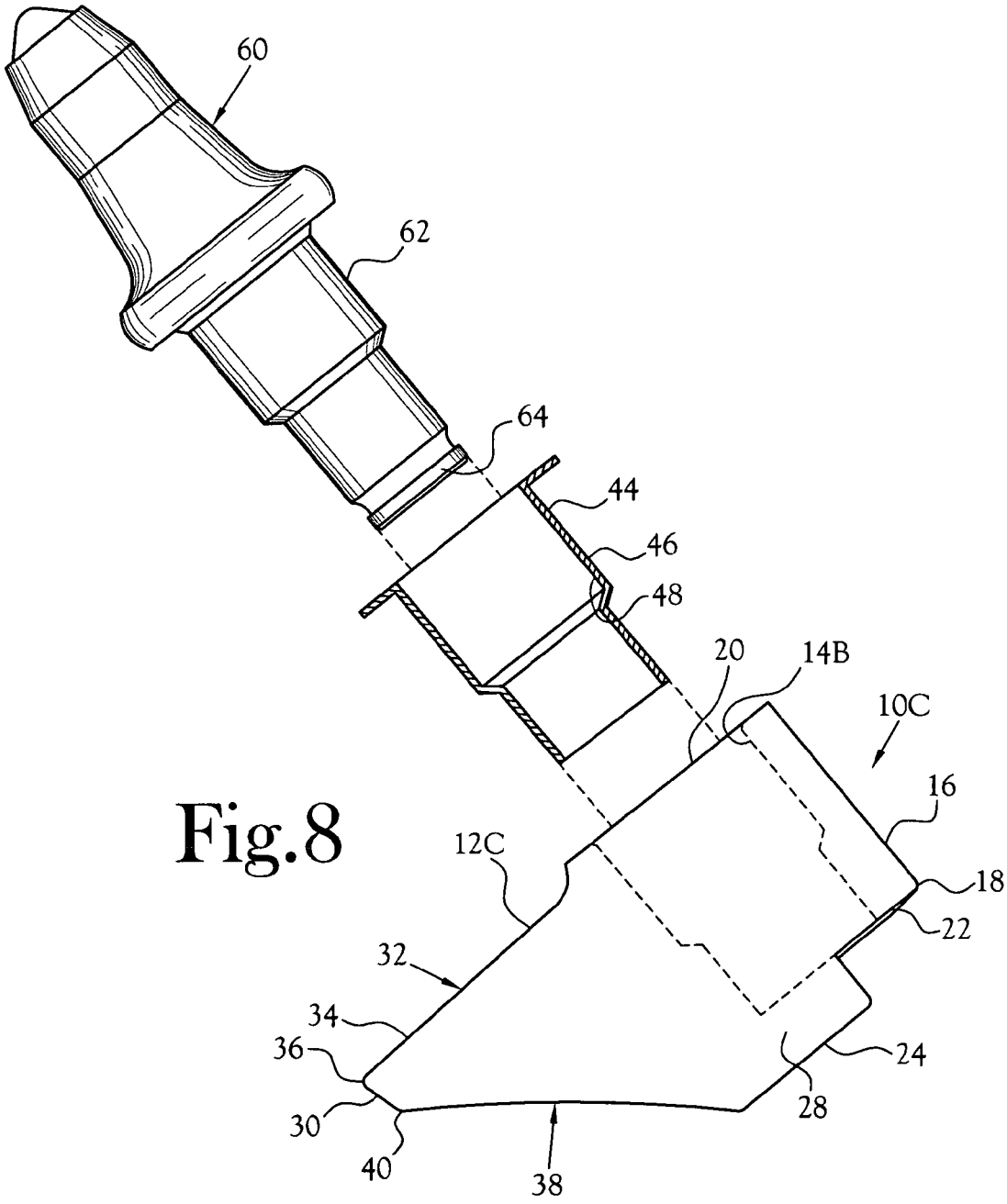
FIG. 8 is an exploded side elevation view of the embodiment of the present invention illustrated in FIG. 7.

The diameter of the inside surface 48 of the bearing sleeve 44 is selected to closely and slideably receive a bit 60 in the bearing sleeve 44. The diameter of the outside surface 46 of the bearing sleeve 44 is selected to be closely and slideably be received within the through opening 14 of the bit block 10C. Further, the thickness of the bearing sleeve 44 varies to adapt the bit block 10C to receive various diameters of bits 60. In some embodiments where a bearing sleeve 44 is used, the through opening of the bit receptor 14B is a greater diameter than embodiments where a bearing sleeve 44 is not used. FIG. 8 illustrates an exploded view of the bit block 10C of FIG. 7, showing the relative engagements between a bit 60, a bearing sleeve 44 and a bit block 10C.

From the foregoing description, it will be recognized by those skilled in the art that a bit block for earth working equipment offering advantages over the prior art has been provided. Specifically, the bit block is designed to mount on excavator equipment and hold a bit during trenching, drilling, boring and mining operations of hard rock or other materials. Further, the bit block is configured to extend the life of the bit block by preventing the mushrooming and difficult removal of the bit from the bit block after repeated use. The bit block defines a shroud that at least partially encircles the protruding lower end of the shank of the bit to provide protection for the lower end of the shank of the bit from bolts on the excavator equipment. The bit block is also configured to define a plow on the leading edge of the bit block which maximizes the amount of removal of rock waste or other materials from the bore hole or trench and increases the efficiency of the drilling, boring, mining or trenching operations. The bit block is further configured to provide a wide welding edge so the bit block is more secure and less likely to be unselectively removed from the drum or plate excavation equipment during excavation.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, I claim:

1. An improved bit block for mounting on earth displacement equipment and for insertion of a bit, the bit having a shank with a first length, the improved bit block defining a gusset at a leading end, the leading end defining a leading edge, a trailing edge defined on a trailing end, a welding surface defining a welding area and a welding edge defining a length, and a bit receptor body having a bit receptor defined by a through opening having a depth less than the first length of the shank of the bit whereby a second length of a distal end of the shank extends from the through opening, the improvement comprising:

a shroud disposed on the trailing end, said shroud having an inner wall and an outer wall, said shroud defining a third length greater than the second length of the shank, said inner wall at least partially encircling the second length of the shank of the bit, whereby the second length of the shank of the bit is received within and protected by said shroud, and whereby said bit block defines an enlarged radius proximate said shroud whereby excavated material is encouraged away from said shroud; and said gusset defining an extended portion extending forwardly away from said bit receptor and beyond the bit, whereby said welding area and said welding edge are each increased, said gusset leading edge and said gusset trailing edge each defining a length greater than a width of said bit receptor body;

said gusset further defining a plow, said leading edge being disposed above and forward from the welding edge, a portion of the leading end between the leading edge and the welding edge defining said plow.

2. The improved bit block of claim 1 wherein said shroud defines a radial arc length of at least 180 degrees.

3. The improved bit block of claim 2 wherein said shroud defines a radial arc length of 360 degrees, whereby the second length of the shank of the bit is substantially received with said shroud.

4. The improved bit block of claim 1 wherein said improvement further includes a removable bearing sleeve defining an outside surface and an inside surface, said outside surface being adapted to be received in the through opening of the bit receptor of the bit block, said inside surface being adapted to receive at least a portion of the shank of the bit wherein said bearing sleeve protects the bit block from wear caused by movement of the shank of the bit.

5. An improved bit block for mounting on earth displacement equipment and for insertion of a bit, the bit having a shank with a first length, the improved bit block defining a gusset at a leading end, the leading end defining a leading edge, a trailing edge defined on a trailing end, a welding surface defining a welding area and a welding edge defining a length, and a bit receptor body having a bit receptor defined by a through opening having a depth less than the first length of the shank of the bit whereby a second length of a distal end of the shank extends from the through opening, the improvement comprising:

a shroud disposed on the trailing end, said shroud having an inner wall and an outer wall, said shroud defining a third length greater than the second length of the shank, said inner wall at least partially encircling the second length of the shank of the bit, whereby the second length of the shank of the bit is received within and protected by said shroud, and whereby said bit block defines an enlarged radius proximate said shroud whereby excavated material is encouraged away from said shroud;

said gusset defining an extended portion extending forwardly away from said bit receptor and beyond the bit, whereby said welding area and said welding edge are each increased; and said gusset leading edge and said gusset trailing edge each defining a length greater than a width of said bit receptor body to define an extended portion carried on each side of the gusset, said extended portion extending laterally away from the gusset, whereby the length of the leading edge is extended to enhance removal of excavated material and to increase the welding surface area, and thereby increase the length of the welding edge;

said gusset further defining a plow, said leading edge being disposed above and forward from the welding edge, a portion of the leading end between the leading edge and the welding edge defining said plow.

6. The improved bit block of claim 5 wherein said shroud defines a radial arc length of at least 180 degrees.

7. The improved bit block of claim 6 wherein said shroud defines a radial arc length of 360 degrees, whereby the second length of the shank of the bit is substantially received with said shroud.

8. The improved bit block of claim 5 wherein said improvement further includes a removable bearing sleeve defining an outside surface and an inside surface, said outside surface being adapted to be received in the through opening of the bit receptor of the bit block, said inside surface being adapted to receive at least a portion of the shank of the bit wherein said bearing sleeve protects the bit block from wear caused by movement of the shank of the bit.

9. An improved bit block for mounting on earth displacement equipment and for insertion of a bit, the bit having a shank with a first length, the improved bit block defining a gusset at a leading end, the leading end defining a leading edge, a trailing edge defined on a trailing end, a welding surface defining a welding area and a welding edge defining a length, and a bit receptor body having a bit receptor defined by a through opening having a depth less than the first length of the shank of the bit whereby a second length of a distal end of the shank extends from the through opening, the improvement comprising:

a shroud disposed on the trailing end, said shroud having an inner wall and an outer wall, said shroud defining a third length greater than the second length of the shank, said inner wall at least partially encircling the second length of the shank of the bit, whereby the second length of the shank of the bit is received within and protected by said shroud, said shroud defining a radial arc length of at least 180 degrees, and whereby said bit block defines an enlarged radius proximate said shroud whereby excavated material is encouraged away from said shroud;

said gusset defining an extended portion extending forwardly away from said bit receptor and beyond the bit, whereby said welding area and said welding edge are each increased;

said gusset leading edge and said gusset trailing edge each defining a length greater than a width of said bit receptor body to define an extended portion carried on each side of the gusset, said extended portion extending laterally away from the gusset, whereby the length of the leading edge is extended to enhance removal of excavated material and to increase the welding surface area, and thereby increase the length of the welding edge;

a plow defined by the gusset, said leading edge being disposed above and forward from the welding edge, a portion of the leading end between the leading edge and the welding edge defining said plow; and a removable bearing sleeve defining an outside surface and an inside surface, said outside surface being adapted to be received in the through opening of the bit receptor of the bit block, said inside surface being adapted to receive at least a portion of the shank of the bit wherein said bearing sleeve protects the bit block from wear caused by movement of the shank of the bit.

10. The improved bit block of claim 9 wherein said shroud defines a radial arc length of 360 degrees, whereby the second length of the shank of the bit is substantially received with said shroud.

11. An improved bit block for mounting on earth displacement equipment and for insertion of a bit, the bit having a shank with a first length, the improved bit block defining a gusset at a leading end, the leading end defining a leading edge, a trailing edge defined on a trailing end, a welding surface defining a welding area and a welding edge defining a length, and a bit receptor body having a bit receptor defined by a through opening having a depth less than the first length of the shank of the bit whereby a second length of a distal end of the shank extends from the through opening, the improvement comprising:

a shroud disposed on the trailing end, said shroud having an inner wall and an outer wall, said shroud defining a third length greater than the second length of the shank, said inner wall at least partially encircling the second length of the shank of the bit, whereby the second length of the shank of the bit is received within and protected by said shroud, and whereby said bit block defines an enlarged radius proximate said shroud whereby excavated material is encouraged away from said shroud; and said gusset defining an extended portion extending forwardly away from said bit receptor and beyond the bit, whereby said welding area and said welding edge are each increased, said gusset leading edge and said gusset trailing edge each defining a length greater than a width of said bit receptor body;

said gusset leading edge defining a length greater than a length defined by said gusset trailing edge.

12. The improved bit block of claim 11 wherein said shroud defines a radial arc length of at least 180 degrees.

13. The improved bit block of claim 12 wherein said shroud defines a radial arc length of 360 degrees, whereby the second length of the shank of the bit is substantially received with said shroud.

14. The improved bit block of claim 11 wherein said improvement further includes a plow defined by the gusset, said leading edge being disposed above and forward from the welding edge, a portion of the leading end between the leading edge and the welding edge defining said plow.

15. The improved bit block of claim 11 wherein said improvement further includes a removable bearing sleeve defining an outside surface and an inside surface, said outside surface being adapted to be received in the through opening of the bit receptor of the bit block, said inside surface being adapted to receive at least a portion of the shank of the bit wherein said bearing sleeve protects the bit block from wear caused by movement of the shank of the bit.

16. An improved bit block for mounting on earth displacement equipment and for insertion of a bit, the bit having a shank with a first length, the improved bit block defining a gusset at a leading end, the leading end defining a leading edge, a trailing edge defined on a trailing end, a welding surface defining a welding area and a welding edge defining a length, and a bit receptor body having a bit receptor defined by a through opening having a depth less than the first length of the shank of the bit whereby a second length of a distal end of the shank extends from the through opening, the improvement comprising:

a shroud disposed on the trailing end, said shroud having an inner wall and an outer wall, said shroud defining a third length greater than the second length of the shank, said inner wall at least partially encircling the second length of the shank of the bit, whereby the second length of the shank of the bit is received within and protected by said shroud, and whereby said bit block defines an enlarged radius proximate said shroud whereby excavated material is encouraged away from said shroud;

said gusset defining an extended portion extending forwardly away from said bit receptor and beyond the bit, whereby said welding area and said welding edge are each increased; and said gusset leading edge and said gusset trailing edge each defining a length greater than a width of said bit receptor body to define an extended portion carried on each side of the gusset, said extended portion extending laterally away from the gusset, whereby the length of the leading edge is extended to enhance removal of excavated material and to increase the welding surface area, and thereby increase the length of the welding edge;

said gusset leading edge defining a length greater than a length defined by said gusset trailing edge.

17. The improved bit block of claim 16 wherein said shroud defines a radial arc length of at least 180 degrees.

18. The improved bit block of claim 17 wherein said shroud defines a radial arc length of 360 degrees, whereby the second length of the shank of the bit is substantially received with said shroud.

19. The improved bit block of claim 16 wherein said improvement further includes a plow defined by the gusset, said leading edge being disposed above and forward from the welding edge, a portion of the leading end between the leading edge and the welding edge defining said plow.

20. The improved bit block of claim 19 wherein said improvement further includes a removable bearing sleeve defining an outside surface and an inside surface, said outside surface being adapted to be received in the through opening of the bit receptor of the bit block, said inside surface being adapted to receive at least a portion of the shank of the bit wherein said bearing sleeve protects the bit block from wear caused by movement of the shank of the bit.

21. An improved bit block for mounting on earth displacement equipment and for insertion of a bit, the bit having a shank with a first length, the improved bit block defining a gusset at a leading end, the leading end defining a leading edge, a trailing edge defined on a trailing end, a welding surface defining a welding area and a welding edge defining a length, and a bit receptor body having a bit receptor defined by a through opening having a depth less than the first length of the shank of the bit whereby a second length of a distal end of the shank extends from the through opening, the improvement comprising:

a shroud disposed on the trailing end, said shroud having an inner wall and an outer wall, said shroud defining a third length greater than the second length of the shank, said inner wall at least partially encircling the second length of the shank of the bit, whereby the second length of the shank of the bit is received within and protected by said shroud, said shroud defining a radial arc length of at least 180 degrees, and whereby said bit block defines an enlarged radius proximate said shroud whereby excavated material is encouraged away from said shroud;

said gusset defining an extended portion extending forwardly away from said bit receptor and beyond the bit, whereby said welding area and said welding edge are each increased;

said gusset leading edge and said gusset trailing edge each defining a length greater than a width of said bit receptor body to define an extended portion carried on each side of the gusset, said extended portion extending laterally away from the gusset, whereby the length of the leading edge is extended to enhance removal of excavated material and to increase the welding surface area, and thereby increase the length of the welding edge;

said gusset leading edge defining a length greater than a length defined by said gusset trailing edge;

a plow defined by the gusset, said leading edge being disposed above and forward from the welding edge, a portion of the leading end between the leading edge and the welding edge defining said plow; and a removable bearing sleeve defining an outside surface and an inside surface, said outside surface being adapted to be received in the through opening of the bit receptor of the bit block, said inside surface being adapted to receive at least a portion of the shank of the bit wherein said bearing sleeve protects the bit block from wear caused by movement of the shank of the bit.

22. The improved bit block of claim 21 wherein said shroud defines a radial arc length of 360 degrees, whereby the second length of the shank of the bit is substantially received with said shroud.

* * * * *